United States Patent [19]

Kelly

[11] Patent Number: 4,811,852

[45] Date of Patent: Mar. 14, 1989

[54] APPAREL HOLDER

[76] Inventor: Thomas J. Kelly, 630 W. Third St., Chadron, Nebr. 69337

[21] Appl. No.: 161,483

[22] Filed: Feb. 29, 1988

[51] Int. Cl.[4] ..... A47F 5/08

[52] U.S. Cl. ..... 211/119; 211/89; 223/DIG. 1

[58] Field of Search ..... 211/13, 119, 4, 7, 89, 211/60.1, 61; 248/251, 289.1, 290, 308, 339, 340; D6/317, 322; 223/88, DIG. 1, 85

[56] References Cited

U.S. PATENT DOCUMENTS

| | | | |
|---|---|---|---|
| D. 191,647 | 10/1961 | Seeger . | |
| 1,664,892 | 4/1928 | Meyer et al. . | |
| 1,891,310 | 12/1932 | Hicks . | |
| 2,058,217 | 10/1936 | Dixon . | |
| 2,085,969 | 7/1937 | Gedeonoff | 248/290 |
| 2,284,979 | 6/1942 | Lazarus . | |
| 2,352,741 | 7/1944 | Singley | 211/89 |
| 2,417,866 | 3/1947 | Duval | 211/7 |
| 2,454,559 | 11/1948 | Kuehn | 211/118 |
| 2,459,331 | 1/1949 | Linenthal | 211/89 |
| 2,473,029 | 6/1949 | Kovacs . | |
| 2,640,598 | 6/1953 | Peacock | 211/119 |
| 2,690,844 | 10/1954 | Torrance | 211/119 |
| 2,929,513 | 3/1960 | Herzberg | 211/89 |
| 2,962,169 | 11/1960 | Landsman | 211/119 |
| 3,370,715 | 2/1968 | Kolozsvari | 211/119 |
| 3,452,881 | 7/1969 | Jamison . | |
| 3,783,995 | 1/1974 | Tobin . | |
| 3,853,225 | 12/1974 | Gegauff | 211/89 |
| 4,429,797 | 2/1984 | Collins . | |

FOREIGN PATENT DOCUMENTS

| | | | |
|---|---|---|---|
| 1438373 | 6/1976 | United Kingdom | 223/DIG. 1 |

*Primary Examiner*—J. Franklin Foss
*Assistant Examiner*—Robert A. Olson
*Attorney, Agent, or Firm*—Burd, Bartz & Gutenkauf

[57] ABSTRACT

A portable tie holder which has a rectangular base and a plurality of movable arms for accommodating ties and like garments. Each arm includes a generally U-shaped rod having an axial end and a lateral end. Hinges are operatively associated with the axial ends of the arms allowing the arms to pivot relative the base. Locks mounted on the base releasably hold the lateral ends of the arms to locate the arms adjacent the base. A hook is mounted on the base whereby the holder may be hung on a fixture.

21 Claims, 4 Drawing Sheets

APPAREL HOLDER

FIELD OF INVENTION

The invention relates to holders for wearing apparel. The holders are adapted for use with a conventional suitcase or in a closet to support a plurality of objects, such as neckties.

BACKGROUND OF INVENTION

It is a habit of many people to hang certain clothing articles, namely ties, scarves, and belts, on doorknobs and other convenient fixtures. The articles become disorganized and sometimes lost. When packed into a suitcase, the clothing articles tend to wrinkle and are hard to locate. Examples of prior wearing apparel holders include closet hangers and wall mounted rack as shown in U.S. Pat. No. 2,473,029. These devices cannot be easily packed into a suitcase. Also, they fail to keep the articles in a neat and orderly fashion. This makes it time consuming and frustrating to locate the desired clothing items.

SUMMARY OF INVENTION

The invention is directed to an article holder for ties and like garments. The holder can be hung in a closet or packed into a suitcase to maintain the articles in convenient and organized locations.

The holder comprises a generally rectangular and flat plate. The plate has a hook for mounting the plate on a support. A plurality of hinges are mounted on each side of the plate. Each hinge is connected to a generally U-shaped arm for holding objects, such as articles of clothing. The arm has an axial end and a lateral end. The axial end is operatively associated with the hinge for pivotal movement relative to the plate from a first position adjacent the plate and a second position spaced from the plate. A releasable lock mounted on the plate is engageable with the lateral end of the arm to hold the arm in the first position adjacent the plate. The arm can be disengaged from the lock and moved from the first position to the second position spaced from the plate to facilitate the placing and removal of garments from the arm.

The holder eliminates the confusion and disorder resulting from not keeping ties and like articles in a neat and functional manner. The ties can be easily seen and each tie can be removed separately. The arms of the holder can be locked to hold the ties in place during travel.

DESCRIPTION OF PREFERRED EMBODIMENT

Figure 1:
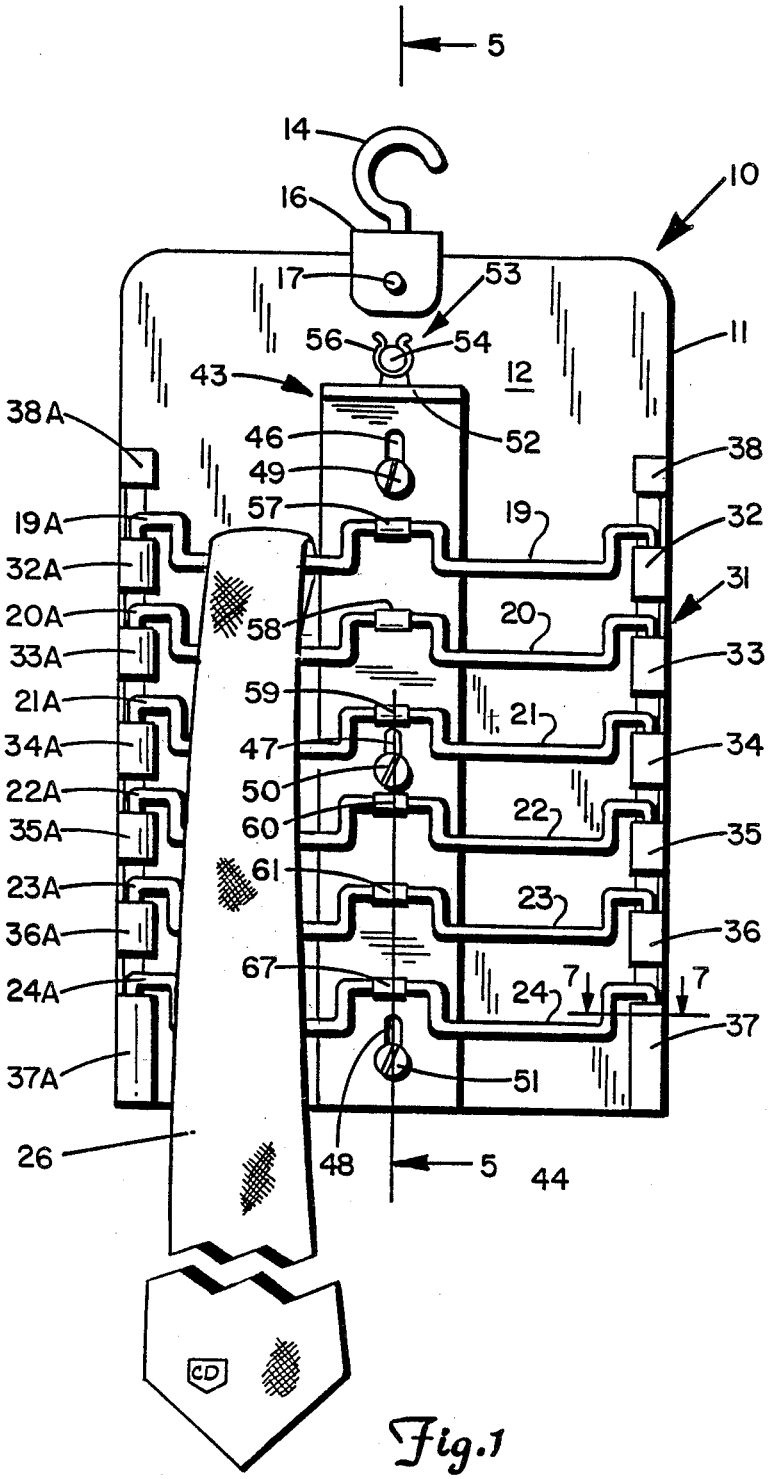
FIG. 1 is a front elevational view of the apparel holder of the invention.
Figure 2:
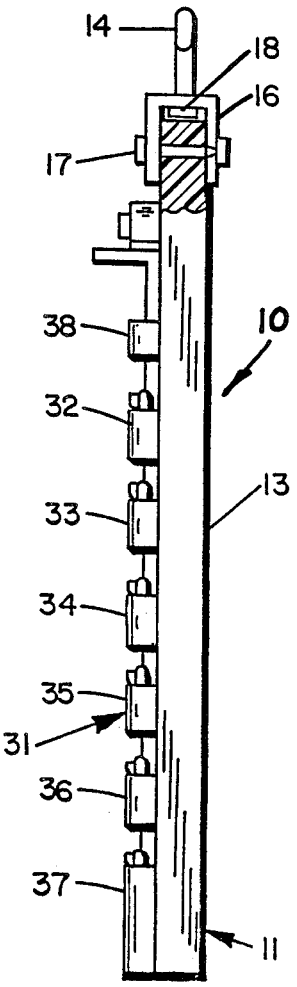
FIG. 2 is a side view of FIG. 1 with parts broken away.

Referring to FIGS. 1 and 2, there is shown an apparel holder of the invention indicated generally at 10 carrying a plurality of neckties 26. Holder 10 can be used to hold other objects such as bow ties, scarves, belts, laces, and the like in convenient and organized locations such as a closet, storage room or box, travel bag, or suitcase. The objects are retained in positions where they can be easily seen and separately removed from and placed on the holder.

Holder 10 has a generally rectangular base 11 of rigid plate-like material such as plastic, metal, or wood. The wood can be mahogany. Base 11 has a generally flat front side 12 and an opposite or flat back side 13. A hook 14 is connected to the center of the top of base 11 with a generally U-sahped bracket 16. A pin 17 connects bracket 16 to base 11. As seen in FIG. 2, hook 14 has an enlarged head 18 located within brackets 16 to allow the hook 14 to swivel relative to bracket 16. Hook 14 has a C-curved shape of a size to fit on a conventional closet rod. Hook 14 can have other shapes and sizes to accommodate a support for the holder.

Holder 10 has a plurality of swinging arms 19, 20, 21, 22, 23, and 24 forming a first set of arms. A second set of swinging arms 19A–24A are located on the opposite half of the front side of base 11. The arms 19–24 and 19A–24A are used to support a plurality of neck ties or other garments. Each arm can hold two or more neck ties. Each arm is movable from a closed position extended away from base 11. When the arm is in the closed position it holds the garment in a selected position. The arm is moved to the open position to release the garment and allow removal of garment from arm and the placing of another garment on the arm. The arm can be moved back to the closed position and retained adjacent base 11 without supporting a garment.

Figure 4:
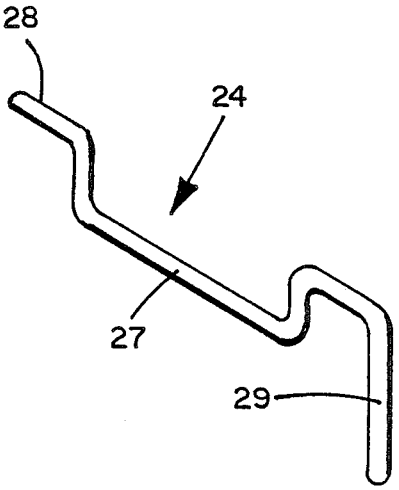
FIG. 4 is a perspective view of a tie holding arm used in the holder of FIG. 1.

Referring to FIG. 4, arm 24 has a generally U-shaped body 27 with an inwardly directed finger 28 at its inner end and a downwardly directed leg or pivot member 29 at its outer end. Arm 24 is a single rod or wire with the finger 28 extended normally or horizontal to the vertical leg 29. The arms 19–24 are pivotally connected to the outer side edge of base 11 with a hinge assembly indicated generally at 31.

Figure 6:
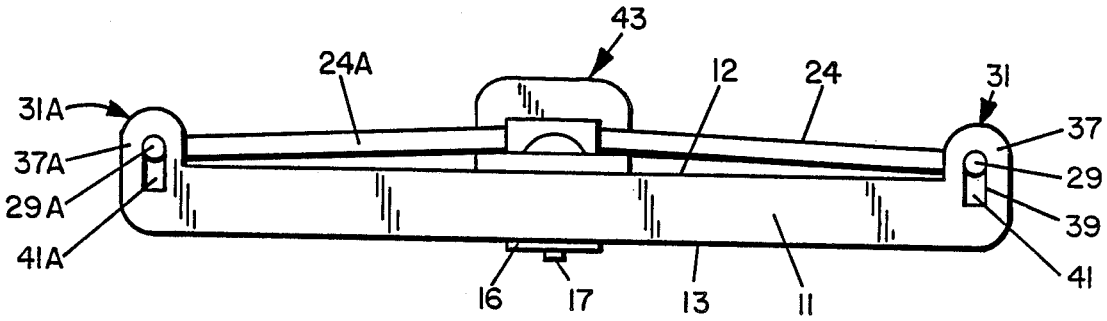
FIG. 6 is an enlarged bottom view of FIG. 1.
Figure 7:
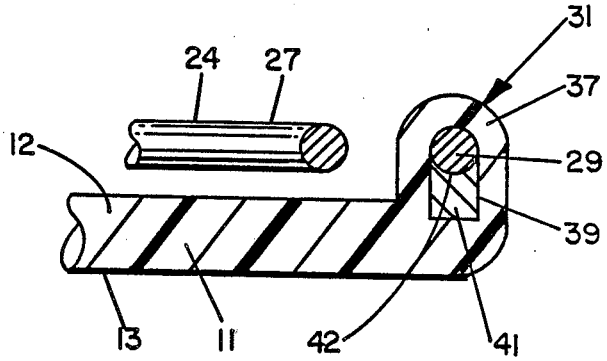
FIG. 7 is an enlarged sectional view taken along the line 7—7 of FIG. 1.
Figure 8:
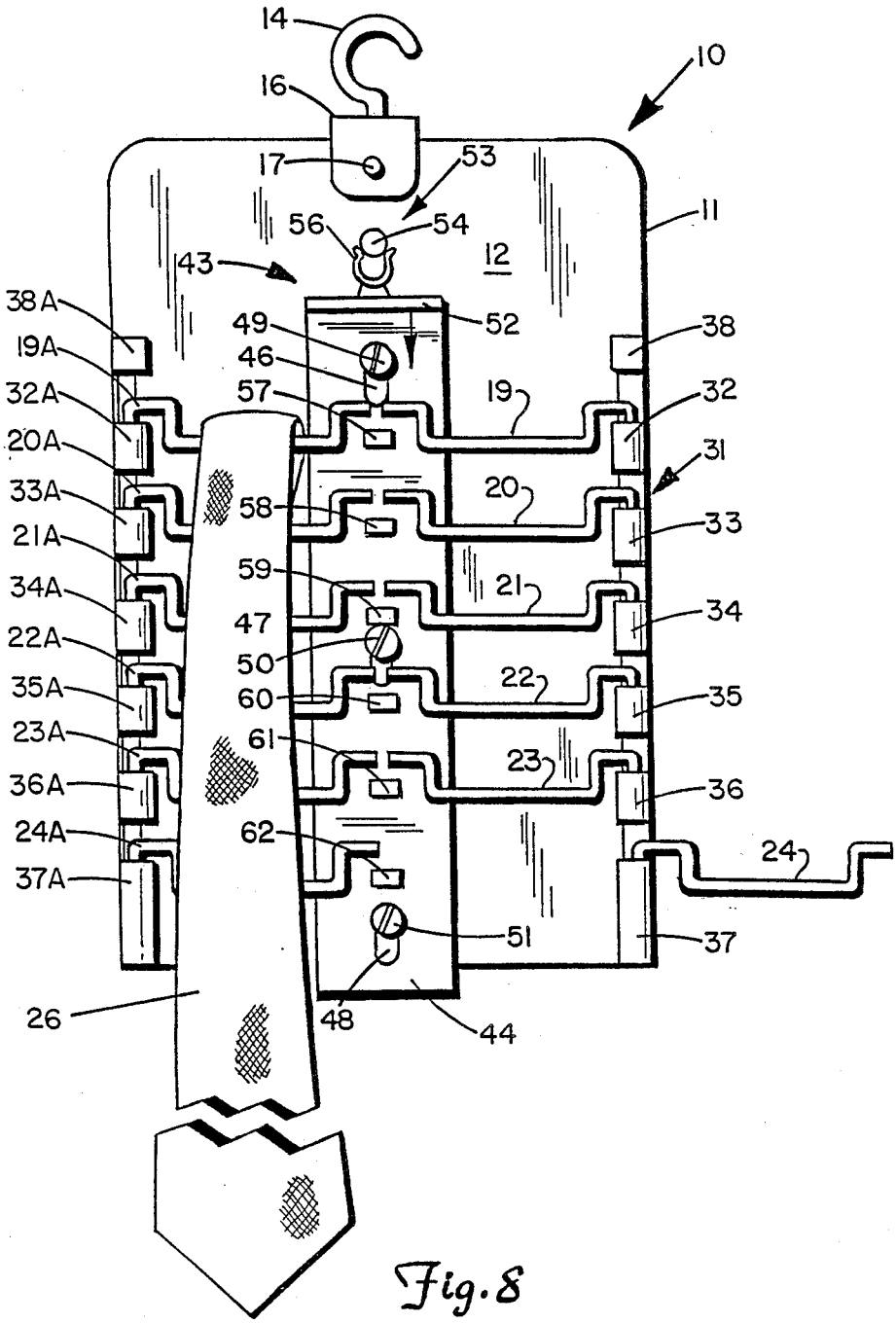
FIG. 8 is a front elevational view similar to FIG. 1 showing the lock plate in the down position and one arm moved to an out position.

Returning to FIGS. 1 and 2, hinge assembly 31 has a plurality of vertically aligned ears 32, 33, 34, 35, 36, and 37 extended along the right edge of base 11. A stop 38 is located above top ear 32. Each ear 32–37 has a generally rectangular slot 39, as seen in FIGS. 6 and 7, that rotatably accommodates a leg 29 of an arm. An elongated holding rod or bar 41 having a convex surface 42 retains legs 39 in rotating upright positions in the ears 32-37. The opposite side of base 11 has corresponding ears 32A, 33A, 34A, 35A, 36A, and 37A that accommodates the legs for the arms 19A–24A. Ears 32–37 and 32A–37A allow arms 19–24 and 19A–24A to pivot individually in an outward direction away from base 11 to open positions so that the ties and other garments can be placed on and removed from the U-shaped bodies of the arms.

Figure 5:
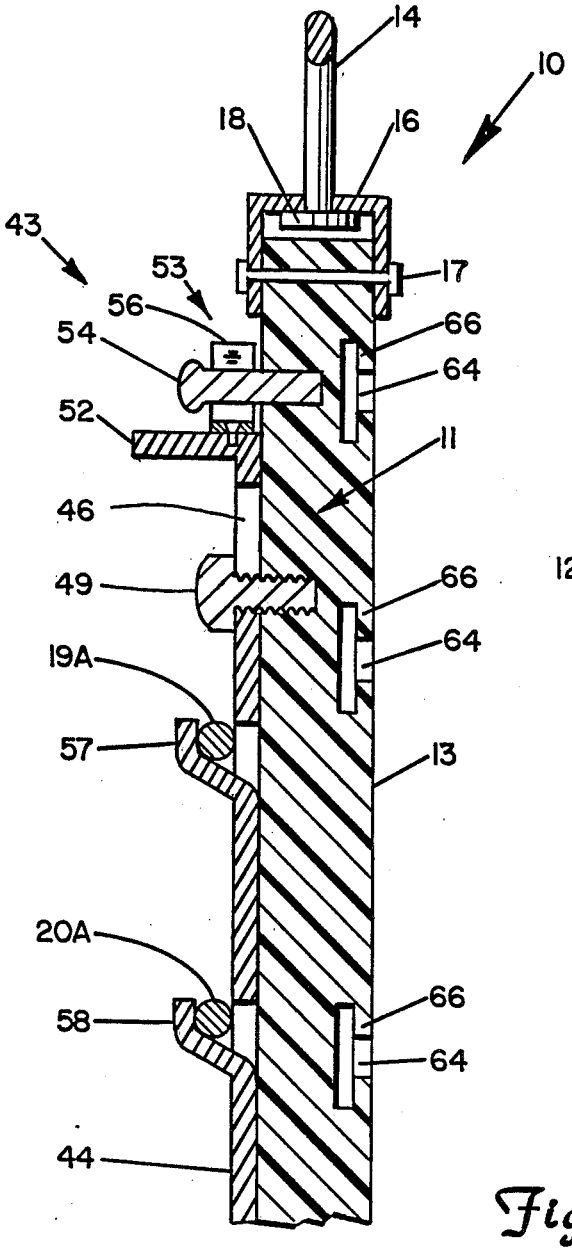
FIG. 5 is a sectional view taken along the line 5—5 of FIG. 1.

Arms 19–24 and 19A–24A are held in their closed position adjacent base 11 by a releasable lock assembly indicated generally at 43 in FIGS. 1 and 5. Lock assembly 43 comprises an elongated lock plate 44 that is slidably positioned along the longitudinal axis of the front side 12 of base 11. Plate 44 has an elongated longitudinal slots 46, 47, and 48 that accommodates screws 49, 50, and 51. As seen in FIG. 5, screws 49–51 extend through slots 46–48 respectively and are fastened to base 11. The screws 49–51 can be threaded into base 11. Alternatively, a captured nut can be located within base 11 to accommodate the threads of the screws. Also, screws 49–51 can be adhesively bonded to base 11. The upper end of plate 44 has an outwardly directed tab 52 that functions as a finger grip to allow plate 44 to be moved between its up locked position and down unlocked position.

A hitch or catch indicated generally at 53 located above plate 44 is used to hold plate 44 in its up or locked position. Catch 53 comprises a pin 54 secured to base 11 and a generally C-shaped clamp 56 is adapted to fit around or grip on pin 54 to hold plate 44 in an up or locked position. The arms of the clamp 56 can be biased outwardly to an open position to allow plate 44 to be moved down to its released position. The arms 19–24 and 19A–24A can then be swung forward or away from base 11 so that it can be unloaded or loaded with neck ties and like garments.

Plate 44 has a plurality of vertically aligned hooks 57, 58, 59, 60, 61, and 62 that hold arms 19–23 and 19A–23A in their in or closed position adjacent base 11. Each hook, as seen in FIG. 5, has an upwardly opened end or mouth laterally spaced from the outside of plate 44 to accommodate the inwardly directed fingers of arms 19–24 and 19A–24A. Each hook accommodates two fingers from the laterally spaced arms. The hooks 57–62, as seen in FIG. 5, may be stamped out of the metal plate 44. Alternatively, separate hook structures can be attached to plate 44.

Figure 3:
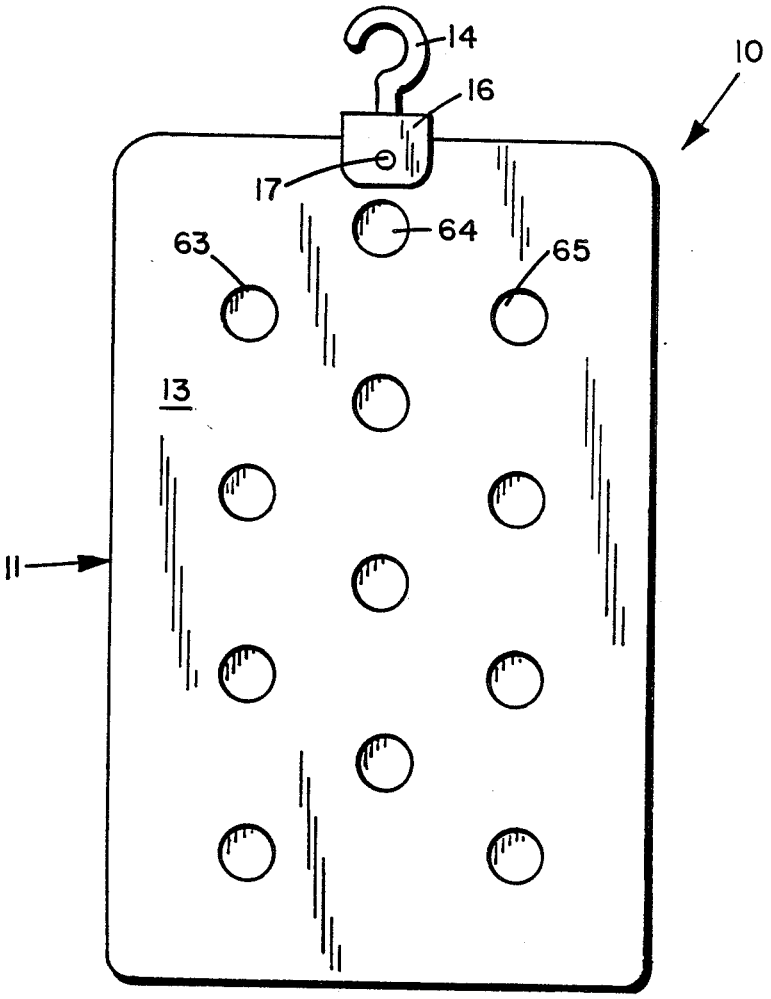
FIG. 3 is a rear elevational view of FIG. 1.

Referring to FIG. 3, the back side of base 11 has a plurality of vertical rows of holes 63, 64, and 65. Preferably, four holes are located in each row of holes. Rows of holes 64 extend down the longitudinal center of base 11. Holes 63 and 65 are transversely aligned and are located on opposite sides of the vertical row of holes 64. Adjacent holes in rows of holes 63, 64, and 65 are equally spaced from each other.

Returning to FIG. 5, the holes 64 have enlarged annular interior rims that provides for an annular lip 66. The lip 66 is used to accommodate a clamp of a snap tie so that snap ties and bow ties can be attached to the back of base 11.

The traveling of the holder is used to accommodate a plurality of neck ties including bow ties and like garments with either a suitcase or storage in a closet or the like. Hook 14 is used to hold the tie holder in place in the suitcase or support to tie holder on a horizontal closet hanger or hook. The ties on arms 19–24 and 19A–24A are maintained in a straight and orderly fashion so they are readily accessible to the user. Lock plate 44 is forced down to a released position. This moves the fingers from arms 19–24 and 19A–24A out from under hooks 57–62. The arms can be individually moved to an out position where the tie draped over the arms can be removed or placed thereon. The arms can then be swung back to their closed position. Lock plate 44 is then raised by gripping the tab 52. The C-clamp 56 is forced over pin 54 whereby hitch 53 is in a holding position. The neckties and like garments are retained in a flat position adjacent base 11 since the arms are not free to rotate about the hinges 31 and 31A.

While there as been shown and described a preferred embodiment of the holder it is understood that changes in the structure, arrangement in structure, and material used in the holder may be altered by those skilled in the art without departing from the invention. The invention is defined in the following claims.

I claim:

1. An apparatus for holding a plurality of objects comprising: a base, hanger means attached to the base for mounting the base on a support, a plurality of arms for holding objects, each arm having a first end and a second end, hinge means operatively associated with the first end of each arm for pivoting the arms for movement relative to the base from a first position adjacent the base and a second position spaced from the base, releasable lock means mounted on the base engageable with the second ends of the arms to hold the arms in the first position adjacent the base, and disengageable from the second ends of the arms to allow the arms to be moved from the first position to the second position, said lock means including a plate located adjacent the base movable between a lock position and an unlock position, said plate having hook means engageable with the second ends of the arms when the plate is in the lock position to hold the arms in the first position, releasable catch means on the base and plate to retain the plate in its lock position, and means mounting the lock means on the base.

2. The apparatus of claim 1 wherein: the base is a generally rectangular plate.

3. The apparatus of claim 1 wherein: the hanger means comprises a hook, and means connecting the hook to the base.

4. The apparatus of claim 1 wherein: each arm includes a generally U-shaped rod with an axial end comprising the first end and a lateral end comprising the second end.

5. The apparatus of claim 1 wherein: the base has a side, said hinge means being mounted on the side of the base.

6. The apparatus of claim 1 wherein: the base has a first side and second side opposite the first side, said hinge means comprising a first hinge mounted on the first side and a second hinge mounted on the second side, said arms comprising first arms connected to the first hinge and second arms connected to the second hinge, said lock means engageable with the first and second arms to hold the first and second arms adjacent the base.

7. The apparatus of claim 6 wherein: each of said first and second arms includes a generally U-shaped rod with a lateral end comprising the second end thereof engageable with the lock means.

8. The apparatus of claim 7 wherein: the first end of each arm is normally disposed relative to the lateral end thereof.

9. The apparatus of claim 7 wherein: the hook means are engageable with said lateral ends to hold the first and second arms adjacent said base.

10. The apparatus of claim 1 wherein: said arms each having a U-shaped rod with a lateral end comprising the second end thereof engagable with the hook means.

11. The apparatus of claim 10 wherein: the first end of each arm is normally disposed relative to the lateral end thereof.

12. The apparatus of claim 1 wherein: the base has a plurality of recesses to accommodate objects.

13. An apparatus for holding a plurality of articles of clothing comprising: a base having a first side and a second side opposite the first side, hanger means connected to the base for mounting the plate on a support, a plurality of first arms for holding articles of clothing, a plurality of second arms for holding articles of clothing, first hinge mounted on the first side of the base, a second hinge mounted on the second side of the base, said first arms being connected to the first hinge for movement from a first position adjacent the base to a second position extended away from the base, said second arms being connected to the second hinge for movement from a first position adjacent the base to a second position extended away from the base, releasable lock means engageable with the first and second arms to hold the first and second arms to hold the first and second arms in the first position adjacent the base; the lock means comprising plate means located adjacent the base operable to hold the first and second arms adjacent the base, and means mounting the plate means on the base for movement to a first position to engage the first and second arms and to a second position to disengage said first and second arms whereby the arms can be moved to their second positions.

14. The apparatus of claim 13 wherein: the hanger means comprises hook, and means connecting the hook to the base.

15. The apparatus of claim 13 wherein: each arm includes a generally U-shaped rod with an axial first end and a lateral second end, the first ends of the first and second arms being operatively associated with the first and second hinges for pivoting the first and second arms for movement relative to the base from a first position adjacent the base and a second position spaced from the base, said lock means engageable with the second ends of the first and second arms to hold the first and second arms adjacent the base, and disengageable with the second ends of the first and second arms to allow the arms to be moved from the first position to the second position.

16. The apparatus of claim 15 wherein: said plate means has hook means engageable with said lateral ends to hold the first and second arms adjacent said base, and releasable catch means on the base and plate means to retain the plate means in its first lock position.

17. The apparatus of claim 13 wherein: the base has a plurality of recesses to accommodate objects.

18. An apparatus for holding an object comprising: a base, hanger means attached to the base for mounting the base on a support, arm means for holding an object having a first end and second end, hinge means operatively associated with the first end of the arm means for pivoting the arm means for movement relative to the base from a first position adjacent the base and a second position spaced from the base, releasable lock means mounted on the base engagable with the second end of the arm means to hold the arms in the first position adjacent the base, and disengagable from the second end of the arm means to allow the arm means to be moved from the first position to the second position, said lock means including a plate located adjacent to base movable between a lock position and an unlock position, said plate having means engagable with the second end of the arm means when the plate in its locked position to hold the arm means in the first position, releasable means on the base and plate to retain the plate in its locked position, and means mounting the plate on the base for movement to said lock position to engage the second end of the arm means to hold the arm means in the first position to the unlock position to allow the arm means to be moved away from said base.

19. The apparatus of claim 18 wherein: the hanger means comprises a hook, and means connecting the hook to the base.

20. The apparatus of claim 18 wherein: the base has a first side and a second side opposite the first side, said hinge means comprising a first hinge mounted on the first side and a second hinge mounted on the second side, said arms means comprising first arms connected to the first hinge and second arms connected to the second hinge, said lock means engagable with the first and second arms to hold the first and second arms adjacent the base.

21. The apparatus of claim 20 wherein: each of said first and second arms includes a generally U-shaped rod with a lateral end comprising the second end thereof engagable with lock means.

* * * * *